US010253591B2

(12) United States Patent
Hazel

(10) Patent No.: US 10,253,591 B2
(45) Date of Patent: Apr. 9, 2019

(54) DOWNHOLE STRING FOR DRILLING THROUGH A LOW PRESSURE ZONE

(71) Applicant: Welltec Oilfield Solutions AG, Zug (CH)

(72) Inventor: Paul Hazel, Aberdeeen (GB)

(73) Assignee: Welltec Oilfield Solutions AG, Zug (CH)

( * ) Notice: Subject to any disclaimer, the term of this patent is extended or adjusted under 35 U.S.C. 154(b) by 56 days.

(21) Appl. No.: 15/311,924

(22) PCT Filed: May 19, 2015

(86) PCT No.: PCT/EP2015/060962

§ 371 (c)(1),
(2) Date: Nov. 17, 2016

(87) PCT Pub. No.: WO2015/177122

PCT Pub. Date: Nov. 26, 2015

(65) Prior Publication Data

US 2017/0101847 A1 Apr. 13, 2017

(30) Foreign Application Priority Data

May 19, 2014 (EP) ..... 14168872

(51) Int. Cl.
*E21B 33/14* (2006.01)
*E21B 33/12* (2006.01)
(Continued)

(52) U.S. Cl.
CPC ..... *E21B 33/1212* (2013.01); *E21B 7/20* (2013.01); *E21B 17/05* (2013.01); *E21B 21/003* (2013.01);
(Continued)

(58) Field of Classification Search
CPC .... E21B 33/12; E21B 33/127; E21B 33/1212; E21B 33/14; E21B 7/20; E21B 34/06
See application file for complete search history.

(56) References Cited

U.S. PATENT DOCUMENTS 5,404,946 A 4/1995 Hess
5,613,567 A * 3/1997 Hudson ..... E21B 7/20 166/278
(Continued)

FOREIGN PATENT DOCUMENTS

CA 2 666 465 A1 4/2008
CN 102459806 A 5/2012
(Continued)

OTHER PUBLICATIONS

International Search Report and Written Opinion of the ISA for PCT/EP2015/060962 dated Mar. 29, 2016, 17 pages.
(Continued)

*Primary Examiner* — Brad Harcourt
*Assistant Examiner* — David Carroll
(74) *Attorney, Agent, or Firm* — Nixon & Vanderhye P.C.

(57) ABSTRACT

The present invention relates to a downhole string (1) for drilling through a low pressure zone (Zlow) in a formation (45) in a well (3), comprising a drawdown casing (2) having a first end (4) closest to a top (5) of the well and a second end (6), and an operational tool (8) connected to the second end of the drawdown casing, wherein the downhole string further comprises an annular barrier (10) having an expandable metal sleeve (11) surrounding the drawdown casing, each end of the expandable metal sleeve being connected with the drawdown casing, the expandable metal sleeve being adapted to contact a wall (16) of a borehole (17) or another casing so that the drawdown casing can rotate and slide in relation to the annular barrier after expansion of the
(Continued)

expandable sleeve. Furthermore, the present invention relates to a downhole system and to a downhole method.

16 Claims, 14 Drawing Sheets

(51) Int. Cl.

| | |
|---|---|
| ***E21B 33/127*** | (2006.01) |
| ***E21B 33/13*** | (2006.01) |
| ***E21B 43/10*** | (2006.01) |
| ***E21B 7/20*** | (2006.01) |
| ***E21B 21/00*** | (2006.01) |
| ***E21B 17/05*** | (2006.01) |
| *E21B 34/06* | (2006.01) |
| *E21B 34/00* | (2006.01) |

(52) U.S. Cl.
CPC ..... *E21B 33/127* (2013.01); *E21B 33/1277* (2013.01); *E21B 33/13* (2013.01); *E21B 33/14* (2013.01); *E21B 43/103* (2013.01); *E21B 34/06* (2013.01); *E21B 2021/006* (2013.01); *E21B 2034/007* (2013.01)

(56) References Cited

U.S. PATENT DOCUMENTS

| | | | | |
|---|---|---|---|---|
| 7,686,076 | B2 | 3/2010 | York et al. | |
| 9,022,113 | B2 * | 5/2015 | Rex | E21B 33/14 166/206 |
| 2004/0245020 | A1 * | 12/2004 | Giroux | B05B 1/00 175/61 |
| 2005/0023003 | A1 * | 2/2005 | Echols | E21B 33/12 166/384 |
| 2006/0016623 | A1 * | 1/2006 | Richard | E21B 7/20 175/57 |
| 2006/0185857 | A1 * | 8/2006 | York | E21B 7/20 166/384 |
| 2008/0264690 | A1 * | 10/2008 | Khan | E21B 21/00 175/25 |
| 2013/0068481 | A1 * | 3/2013 | Zhou | E21B 43/10 166/381 |

FOREIGN PATENT DOCUMENTS

| | | | |
|---|---|---|---|
| CN | 102575508 | A | 7/2012 |
| EP | 2 305 947 | | 4/2011 |
| EP | 2 644 821 | A1 | 10/2013 |
| SU | 1571218 | A1 | 6/1990 |
| SU | 1737101 | A1 | 5/1992 |
| WO | WO 2010/136806 | | 12/2010 |
| WO | WO 2013/011293 | | 1/2013 |
| WO | WO 2013/092801 | A1 | 6/2013 |

OTHER PUBLICATIONS

Search Report for EP 14168872.1, dated Apr. 13, 2015, 10 pages.
Notification of the First Office Action dated Sep. 5, 2018 in Chinese Application No. 201580023168.7, with English translation (18 pages).
Office Action of Substantive Examination dated Dec. 21, 2018 in Russian Application No. 2016147665/03(076558), with English translation (13 pages).

* cited by examiner

DOWNHOLE STRING FOR DRILLING THROUGH A LOW PRESSURE ZONE

This application is the U.S. national phase of International Application No. PCT/EP2015/060962 filed May 19, 2015 which designated the U.S. and claims priority to European Patent Application No. 14168872.1 filed on May 19, 2014, the entire contents of each of which are hereby incorporated by reference.

FIELD OF THE INVENTION

The present invention relates to a downhole string for drilling through a low pressure zone in a formation in a well. Furthermore, the present invention relates to a downhole system and to a downhole method.

BACKGROUND ART

When drilling a new borehole or a sidetrack in an existing well, the drilling head may drill into a low pressure zone, resulting in a loss of pressure. Thus, the mud entered into the hole while drilling to prevent blowout is lost in the low pressure zone, and there will be a substantial risk of a blowout if the drilling is continued. Cementing and thus sealing part of the annulus above the low pressure zone are also impossible, since the injected cement is lost as it disappears into the low pressure zone, and then this partly drilled borehole is abandoned and plugged from above and a new well is drilled.

SUMMARY OF THE INVENTION

It is an object of the present invention to wholly or partly overcome the above disadvantages and drawbacks of the prior art. More specifically, it is an object to provide an improved completion or drilling system which renders it possible to continue drilling past the above-mentioned low pressure zone.

The above objects, together with numerous other objects, advantages and features, which will become evident from the below description, are accomplished by a solution in accordance with the present invention by a downhole string for drilling through a low pressure zone in a formation in a well, comprising

- a drawdown casing having a first end closest to a top of the well and a second end, and
- an operational tool connected to the second end of the drawdown casing, wherein the downhole string further comprises an annular barrier having an expandable metal sleeve surrounding the drawdown casing, each end of the expandable metal sleeve being connected with the drawdown casing, the expandable metal sleeve being adapted to contact a wall of a borehole or another casing so that the drawdown casing can rotate and slide in relation to the annular barrier after expansion of the expandable sleeve.

In an embodiment, the annular barrier may be connected with the drawdown casing after expansion of the expandable sleeve.

Furthermore, the annular barrier may be slidably and/or rotationally connected with the drawdown casing after expansion of the expandable sleeve.

The downhole string may further comprise a swivel mounted as part of the drawdown casing, dividing the drawdown casing into a first casing part and a second casing part for rotating the first casing part in relation to the second casing part.

In an embodiment, the swivel may comprise a first swivel part connected to the first casing part and a second swivel part connected to a second casing part.

Furthermore, a ball bearing may be arranged between the first swivel part and the second swivel part.

Also, a sealing element may be arranged between the first swivel part and the second swivel part.

Moreover, the second casing part may be connected with the operational tool and the annular barrier.

In addition, the drawdown casing may comprise openings arranged above the annular barrier.

An annular space may be arranged between the expandable metal sleeve and the drawdown casing.

Moreover, the annular space may comprise a compound adapted to expand the annular space.

Also, the compound may comprise at least one thermally decomposable compound adapted to generate gas or supercritical fluid upon decomposition.

Further, the compound may comprise nitrogen.

In addition, the compound may be selected from a group consisting of: ammonium dichromate, ammonium nitrate, ammonium nitrite, barium azide, sodium nitrate, or a combination thereof.

Furthermore, the compound may be present in the form of a powder, a powder dispersed in a liquid or a powder dissolved in a liquid.

An opening may be arranged in the drawdown casing opposite the expandable metal sleeve for letting pressurised fluid into the annular space to expand the expandable metal sleeve.

Moreover, a valve may be arranged in the opening.

Said valve may be a check valve.

Also, the valve may comprise an activatable closing element so that when an end of the expandable metal sleeve passes the activatable closing element, the valve is closed.

One or both ends of the expandable metal sleeve may be connected with the drawdown casing by means of connection parts.

Furthermore, a sealing means may be arranged between the connection part or end of the expandable metal sleeve and the drawdown casing.

Additionally, the operational tool may be a reamer, a drill head or a cement shoe.

Further, the drawdown casing may be mounted from tubular casing sections by means of casing collars.

Moreover, the drawdown casing may be capable of sliding between two adjacent casing collars.

Also, a sliding sleeve or a frac port may be arranged in the drawdown casing closer to the first end in relation to the annular barrier.

The present invention also relates to a downhole system for drilling through a low pressure zone in a formation in a well, comprising:

- a downhole string as described above, and
- an operating unit for sliding and/or rotating the drawdown casing.

Said operational unit may also be used for sliding and/or rotating the drawdown casing in relation to the expanded expandable metal sleeve.

The downhole system as described above may further comprise a pressurising unit for pressurising a fluid in the drawdown casing for expanding the expandable metal sleeve.

Furthermore, the downhole system as described above may further comprise a downhole tool, such as a cementing tool.

Moreover, the downhole system may further comprise a ball configured to be dropped into the drawdown casing for seating in a seat and closing part of the casing.

Additionally, the downhole system may comprise a drilling head connected in an end of a drill pipe for drilling from within the drawdown casing out into the formation.

The present invention furthermore relates to a downhole method for drilling past a low pressure zone in a formation in a well, comprising the steps of:

drilling a borehole in the formation, determining a low pressure zone in the formation, expanding an annular barrier above the low pressure zone in relation to a top of the borehole, providing cement above the annular barrier in an annulus between the casing and a wall of the borehole, oscillating or rotating at least part of the casing in relation to the annular barrier while cementing, after expansion of the expandable sleeve, and drilling past the low pressure zone.

The step of drilling past the low pressure zone may be performed after a drilling head and a drill pipe have been inserted into the casing.

Moreover, the step of providing cement may be performed after a cementing tool has been arranged opposite an opening in the casing above the annular barrier.

In addition, the cementing tool may be removed from the casing before the drilling head is introduced.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
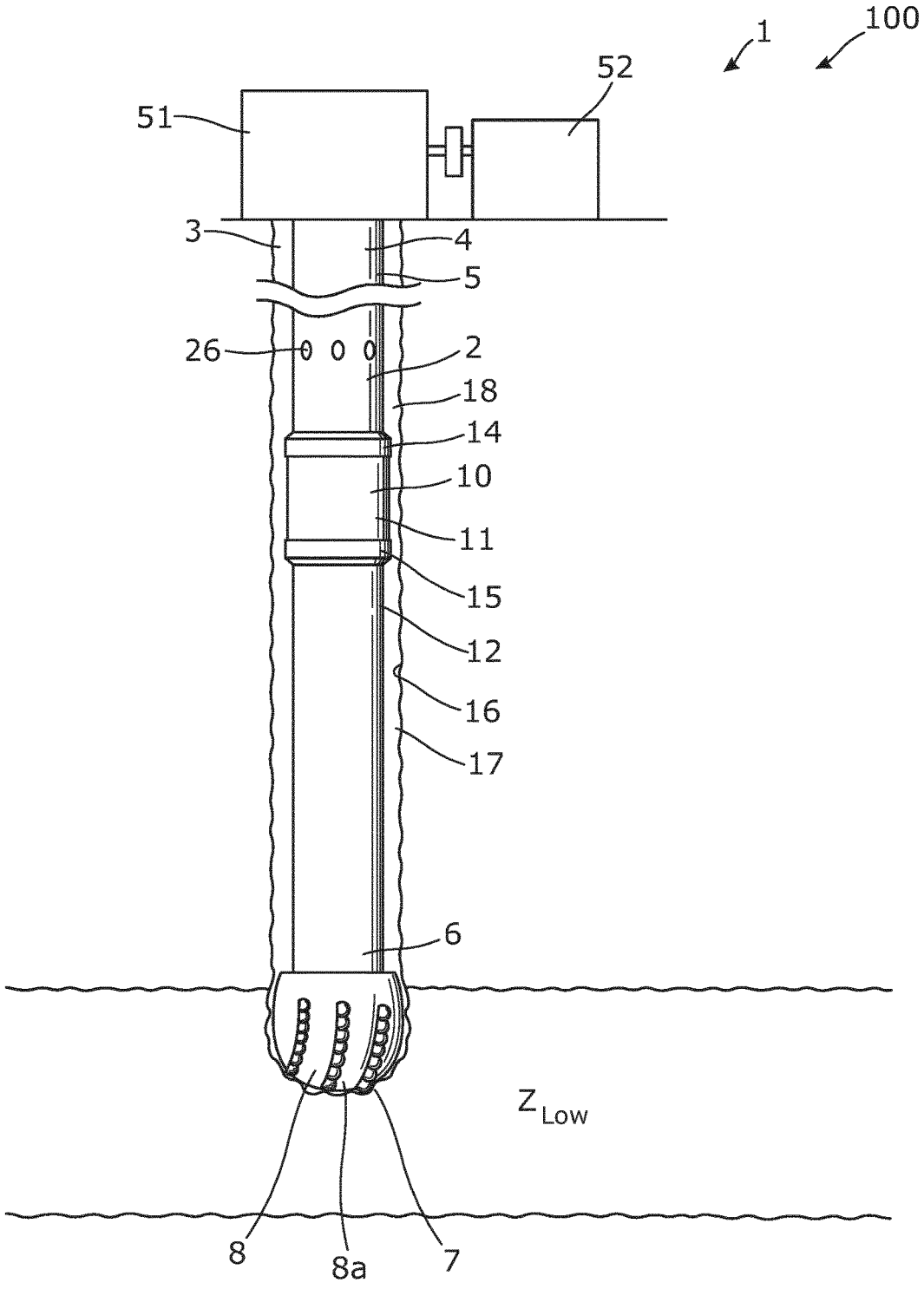
FIG. 1 shows a partial cross-sectional view of a downhole string for drilling through a low pressure zone.

FIG. 1 shows a downhole string 1 for drilling through a low pressure zone $Z_{low}$ in a formation in a well 3. The downhole string 1 comprises a drawdown casing 2 having a first end 4 closest to a top 5 of the well 3 and a second end 6 closer to the bottom 7 of the well. The downhole string 1 further comprises an operational tool 8 connected to the second end 6 of the drawdown casing 2 for performing part of the drilling operation.

Figure 2:
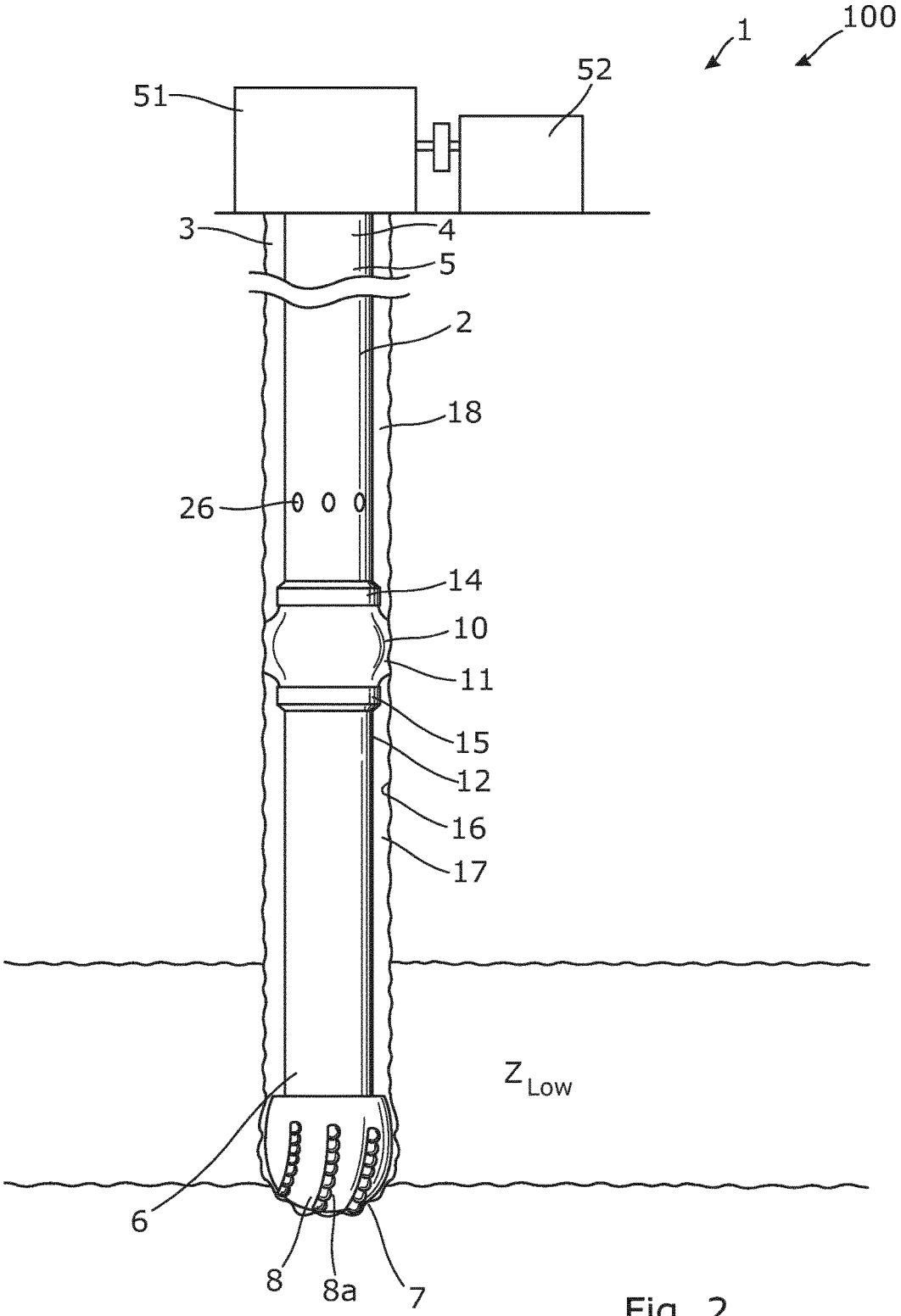
FIG. 2 shows the downhole string of FIG. 1 after the annular barrier has been expanded.

When drilling a new borehole or a sidetrack in an existing well, the drilling head 8*a*, 8 may drill into a low pressure zone $Z_{low}$, and the mud entered into the hole while drilling to prevent blowout may consequently be lost in the low pressure zone, and thus, there will be a substantial risk of a blowout if the drilling is continued. In order to prevent a loss of pressure, the downhole string 1 comprises an annular barrier 10 having an expandable metal sleeve 11 surrounding the drawdown casing 2. Each end 14, 15 of the expandable metal sleeve 11 is connected on the outside 12 of the drawdown casing 2. The annular barrier 10 has an unexpanded condition, as shown in FIG. 1, and an expanded condition, as shown in FIG. 2. When entering the low pressure zone $Z_{low}$, the expandable metal sleeve 11 is expanded to contact a wall 16 of a borehole 17, as shown in FIG. 2, or another casing (not shown). In this way, the well is secured in that the annular barrier 10 together with the drawdown casing 2 prevent a formation fluid from creating a blowout.

Figure 3:
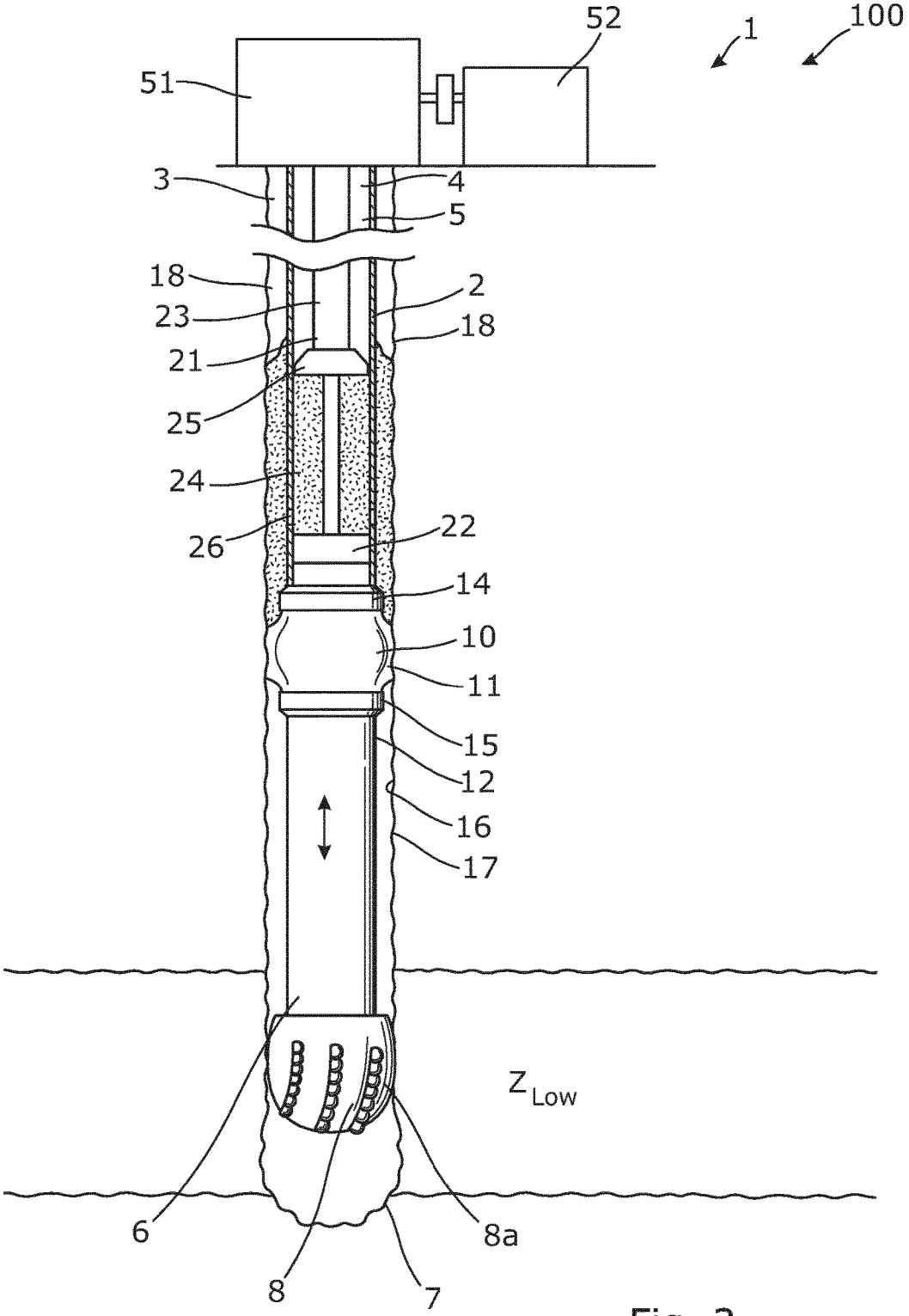
FIG. 3 shows the downhole string of FIG. 1 while cementing above the annular barrier.

Subsequently, another operation is performed, such as cementing the annulus 18 above the annular barrier 10. While performing this subsequent job, the drawdown casing 2 can rotate and slide in relation to the annular barrier 10 which is securely fastened to the borehole wall 16. This renders it possible to carry out the subsequent operation, e.g. cementing the annulus 18 above the annular barrier 10, as shown in FIG. 3, or continue the drilling operation. This is due to the fact that the expandable metal sleeve 11 is made of metal providing the rigidity necessary for allowing the drawdown casing 2 to move relative to the annular barrier 10.

In order to cement the annulus 18 above the annular barrier 10, a downhole tool 21 in the form of a cementing tool is submerged into the drawdown casing 2. The cementing tool 21 is arranged opposite the zone which is to be cemented, and a first packer 22 or bottom packer of the cementing tool 21 is set to close off the bottom part of the drawdown casing 2. Cement is then pumped down through the pipe string 23 and into the space 24 in the drawdown casing 2 between the first packer and a second packer 25 and into the annulus 18 above the annular barrier 10. The second packer 25 may be a cup seal movable towards the first packer to squeeze the cement out through openings 26 in the drawdown casing above the annular barrier 10. While cementing, the drawdown casing 2 oscillates up and down, as illustrated by the double arrow, to ensure that bubbles are not formed in the cement and that a proper cementing job is executed. This oscillating movement of the drawdown casing 2 in relation to the annular barrier 10 is thus important to the subsequent cementing job.

Figure 4:
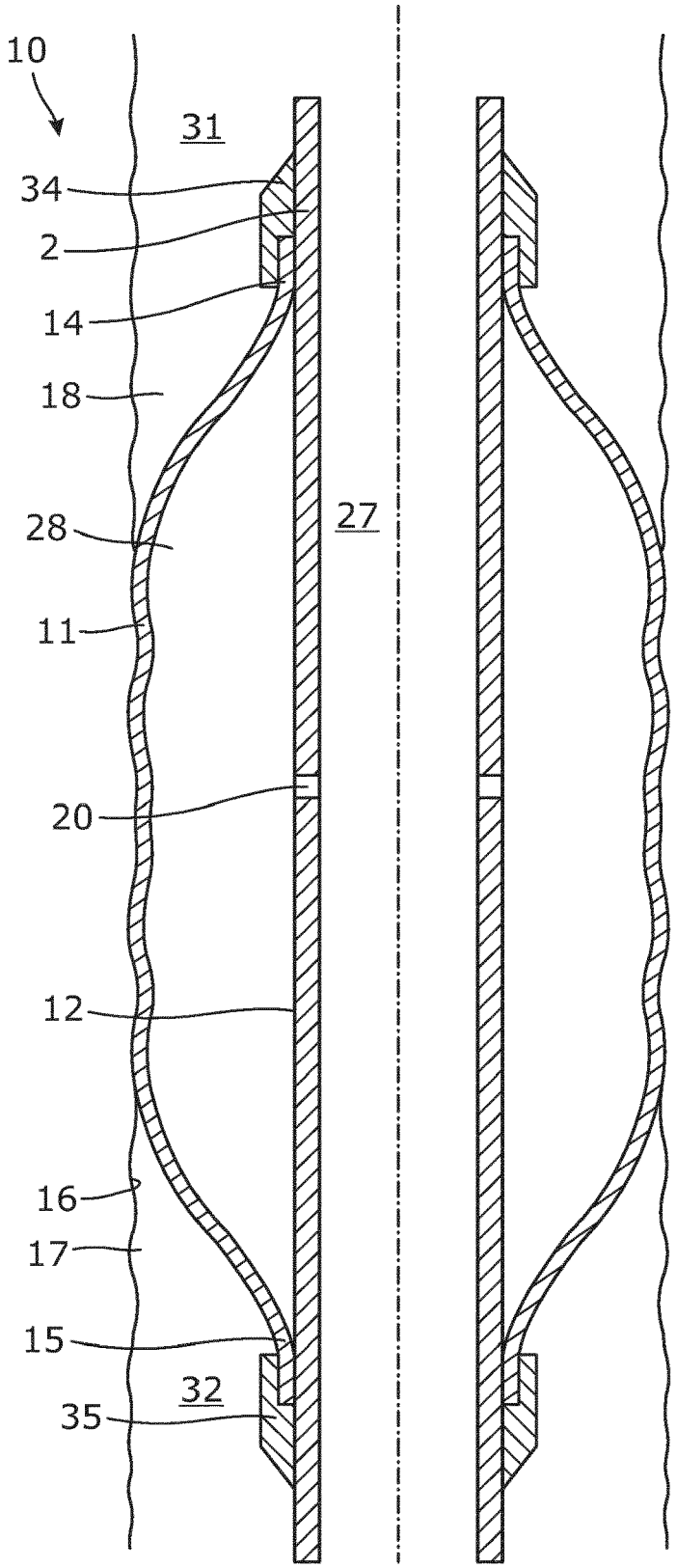
FIG. 4 shows a cross-sectional view of one annular barrier.

The annular barrier 10 comprises an expandable metal sleeve 11 which is connected with the drawdown casing 2 to form an annular space 28, as shown in FIG. 4. The annular barrier 10 is expanded by pressurising an inside 27 of the drawdown casing 2 and letting this pressurised fluid into the annular space 28 through an opening 20 in the drawdown casing 2 opposite the annular barrier, thus expanding the sleeve to contact the wall 16 of the borehole 17 and isolate a top first part 31 from a bottom second part 32 of the drawdown casing 2 and thus prevent a loss of pressure or blowout.

Figure 5:
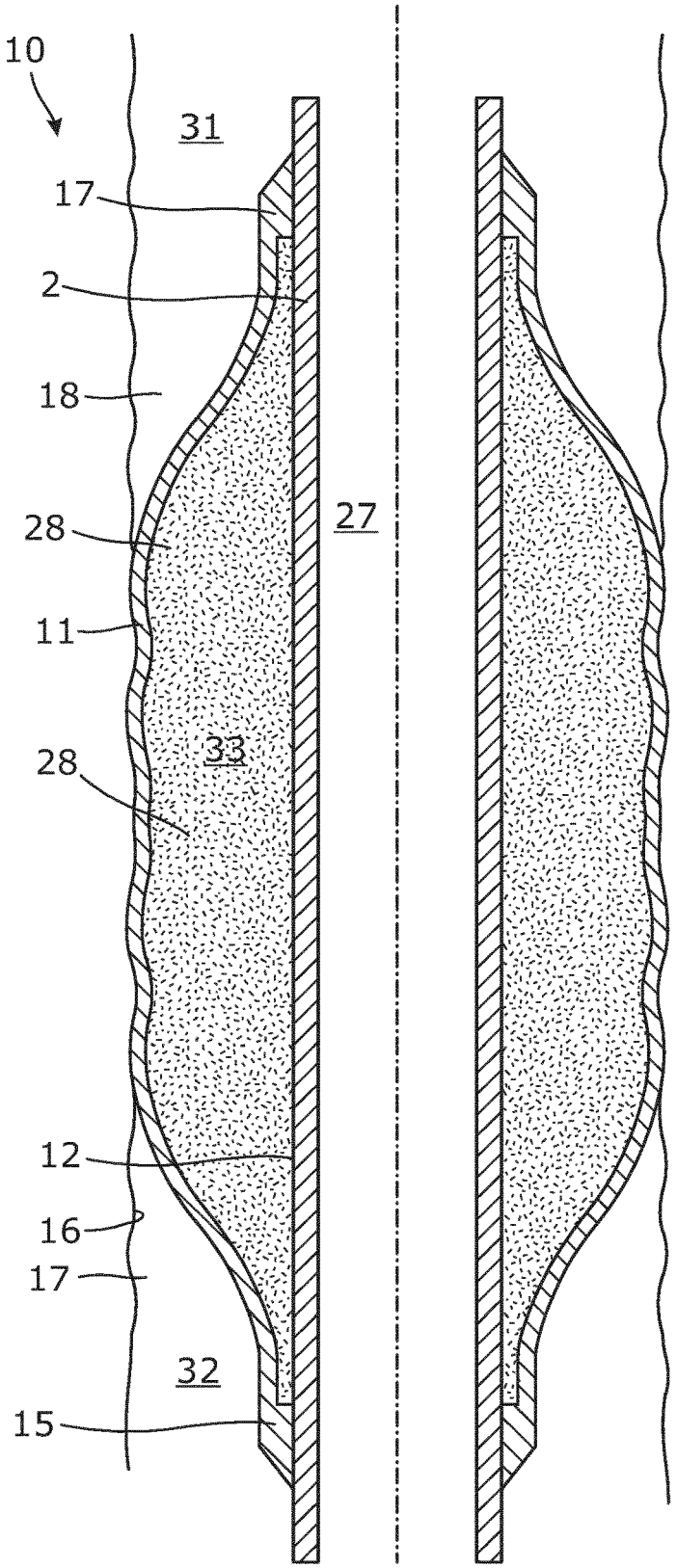
FIG. 5 shows a cross-sectional view of another annular barrier.

In another solution shown in FIG. 5, the annular barrier 10 is expanded by activating a compound 33 present in the annular barrier 10 when submerging the drawdown casing 2. When activating the compound 33, the compound reacts chemically or the compound decomposes to generate gas or super-critical fluid upon decomposition. The compound 33 may comprise nitrogen and may be selected from a group consisting of: ammonium dichromate, ammonium nitrate, ammonium nitrite, barium azide, sodium nitrate, or a combination thereof. The compound may be present in the form of a powder, a powder dispersed in a liquid or a powder dissolved in a liquid.

Figure 6:
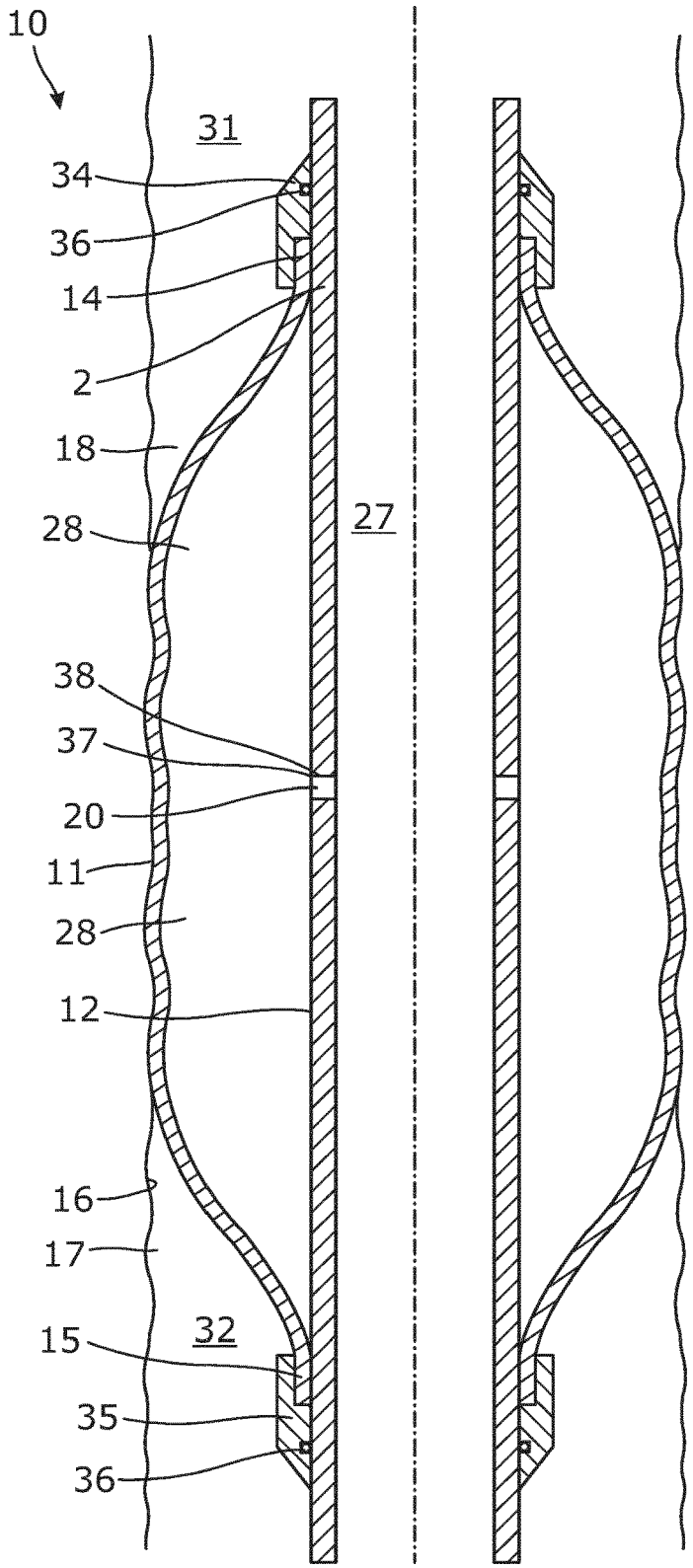
FIG. 6 shows a cross-sectional view of yet another annular barrier.

As shown in FIG. 5, the expandable metal sleeve 11 is connected directly to the outer face 12 of the drawdown casing 2 in that the expandable metal sleeve 11 has ends 14, 15 having an increased thickness so that the ends 14, 15 stay unexpanded during the expansion process. In FIGS. 4 and 6, the expandable metal sleeve 11 is connected to the outer face 12 of the drawdown casing by means of first and second connection parts 34, 35 in the form of ring-shaped elements. In order to increase the sealing between the drawdown casing 2 and the expandable metal sleeve ends or the connection parts, sealing elements 36 may be arranged, as shown in FIG. 6.

Figure 7:
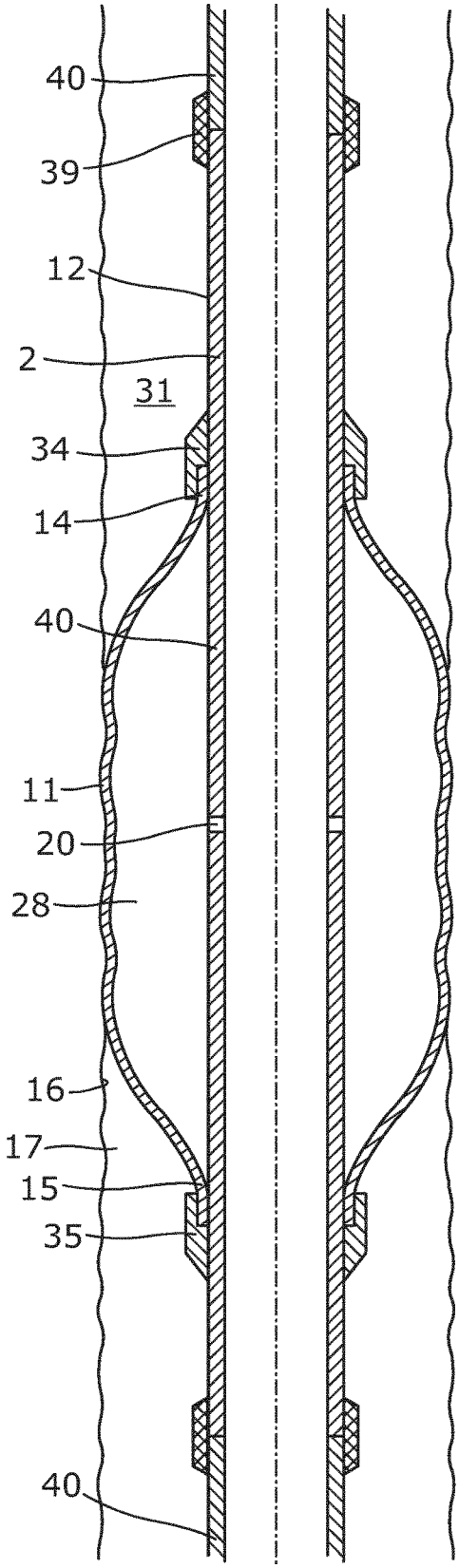
FIG. 7 shows a cross-sectional view of an annular barrier in relation to casing collars.

To prevent fluid from leaving the annular space 28 in the annular barrier 10, a valve 38 is arranged in the opening 20, as shown in FIG. 6. The valve 38 may be a check valve so that fluid may enter the valve in order to expand the expandable metal sleeve 11, but is prevented from returning into the drawdown casing 2. The valve 38 comprises an activatable closing element 37 so that when an end of the expandable metal sleeve 11 passes the activatable closing element 37, the valve 38 is closed to close off the drawdown casing 2 as the annular barrier 10 is no longer closing off the opening 20 in relation to the formation fluid, as the annular barrier has slid past the opening 20. As can be seen in FIG. 7, the drawdown casing 2 is capable of sliding between two adjacent casing collars 39 connecting two casing sections 40 from which the drawdown casing is mounted.

Figure 8:
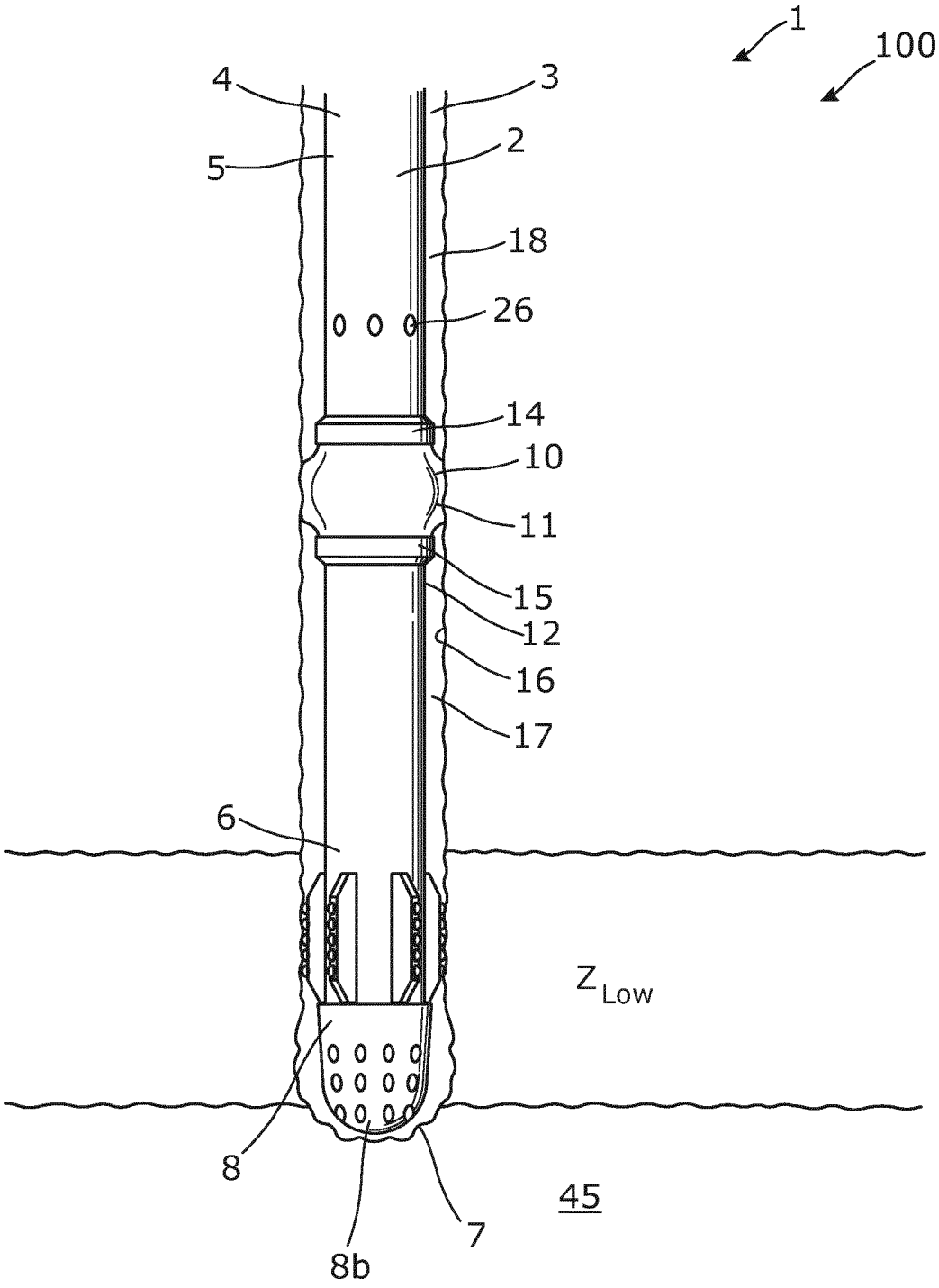
FIG. 8 shows a partial cross-sectional view of another downhole string for drilling through a low pressure zone by means of a reamer.
Figure 9:
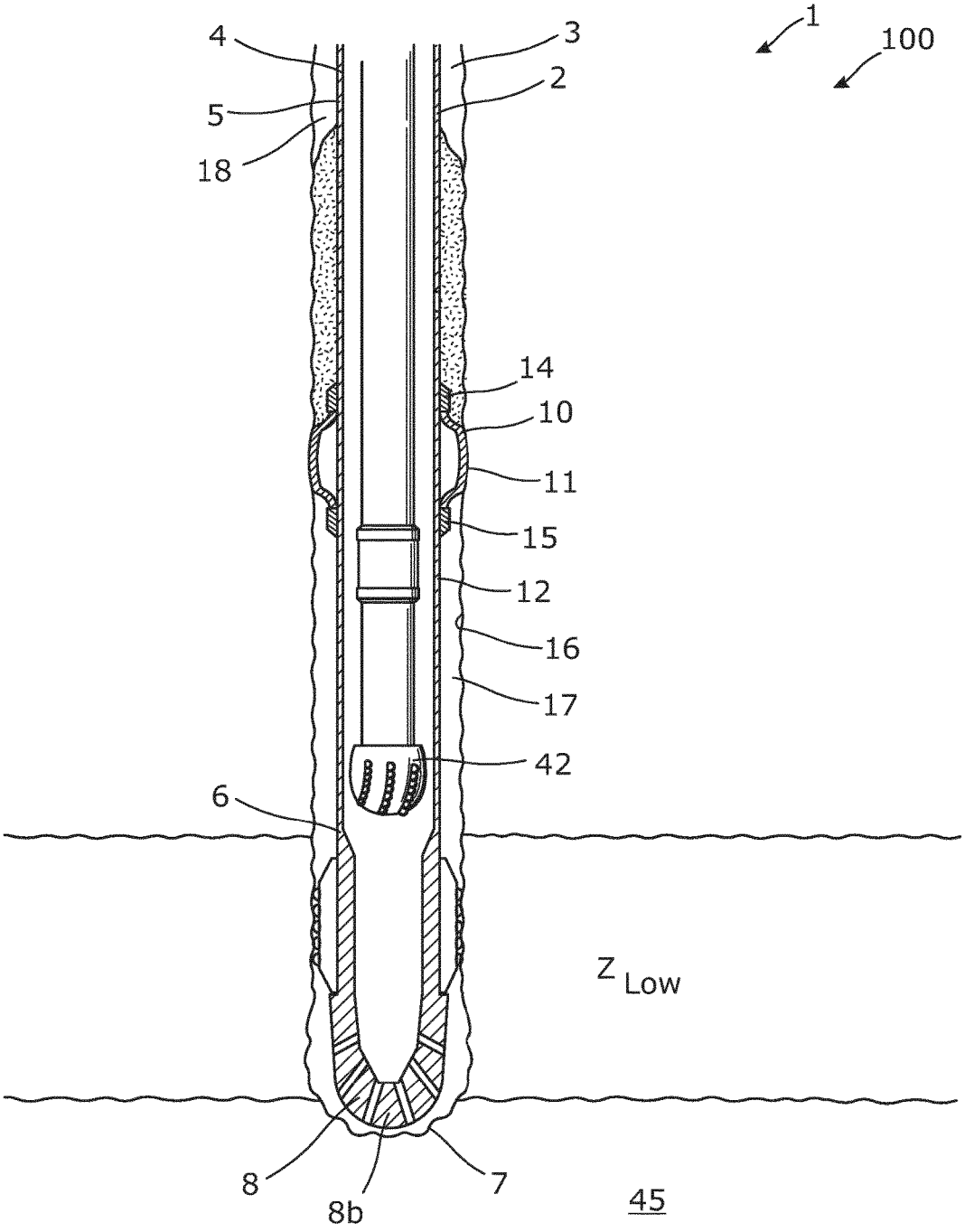
FIG. 9 shows the downhole string of FIG. 1 while a second drilling head is inserted.

In FIGS. 1-3, the annular barrier 10 is connected to a drawdown casing 2 and thereby to a first drilling head 8*a*, 8. When drilling, the drilling head 8*a*, 8 may be replaced by a reamer 8 (shown in FIG. 8), and the annular barrier 10 may thus be connected to the drawdown casing 2 having the reamer, as shown in FIG. 8. When the reamer 8*b* meets the low pressure zone Zlow, the annular barrier 10 is expanded and the annulus 18 above the annular barrier 10 is cemented. Subsequently, the drilling process is continued by inserting a second drilling head 42 (shown in FIG. 9), e.g. on the drill pipe, having a smaller outer diameter than an inner diameter of the drawdown casing 2. Then, the second drilling head 42 drills through the reamer 8*b* and through the low pressure zone Zlow and further out into the formation, thus prolonging the borehole. While the second drilling head 42 drills, mud matching the challenge of drilling through low pressure zones is ejected to seal off the low pressure zone.

Figure 10:
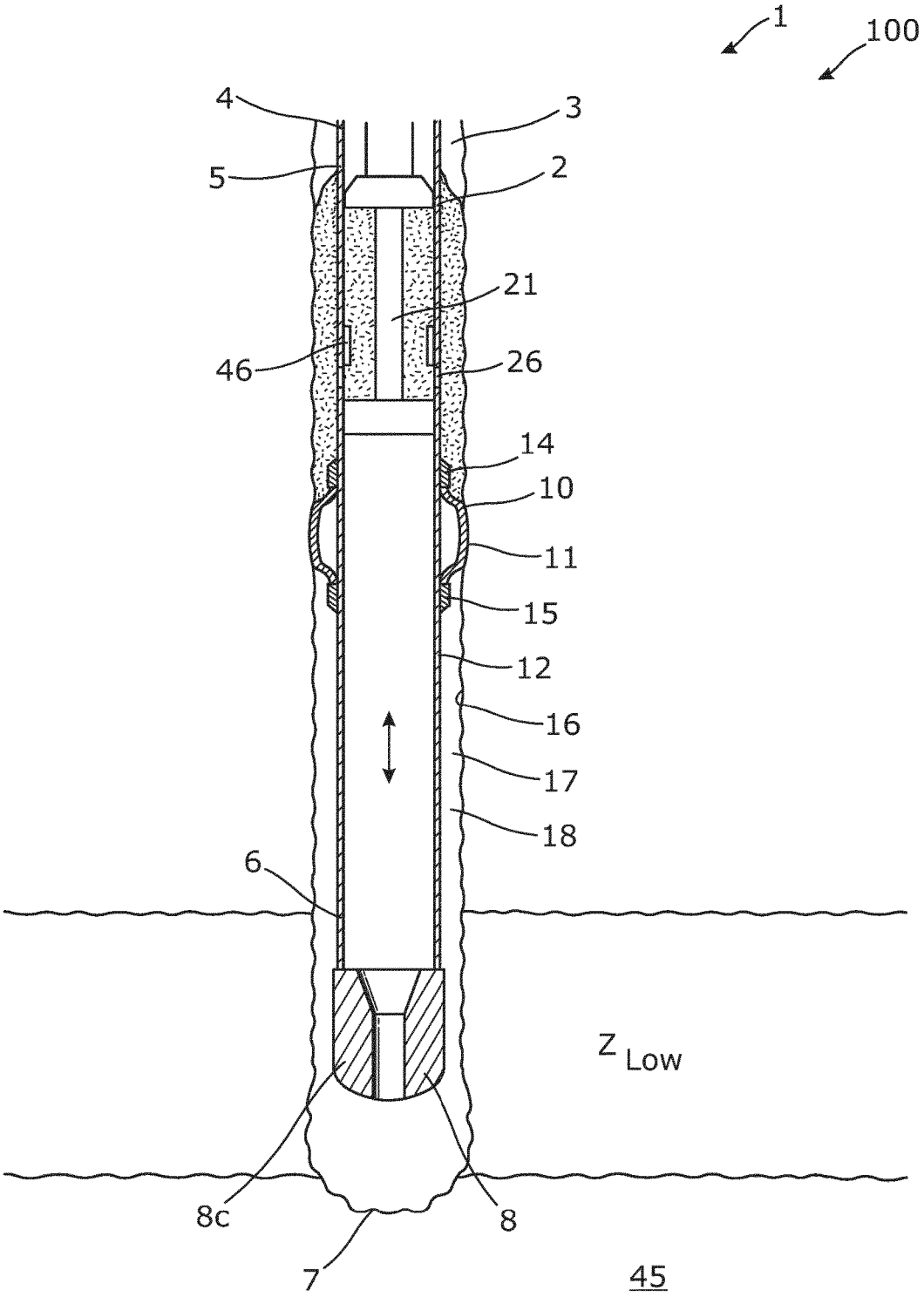
FIG. 10 shows a partial cross-sectional view of another downhole string.

As shown in FIG. 10, the operational tool 8 may also be a shoe 8*c*, such as a cement shoe, a guide shoe or a float shoe. When the cementing tool 21 has cemented the annulus 18 above the annular barrier 10, a second drilling head is inserted and the mud is likewise replaced with a suitable mud for drilling through the shoe and further into the formation 45.

In FIG. 10, the openings 26 in the drawdown casing 2 above the annular barrier 10 is a port, such as a frac port, where a sliding sleeve 46 is slidably arranged for opening or closing the opening 26.

Figure 11:
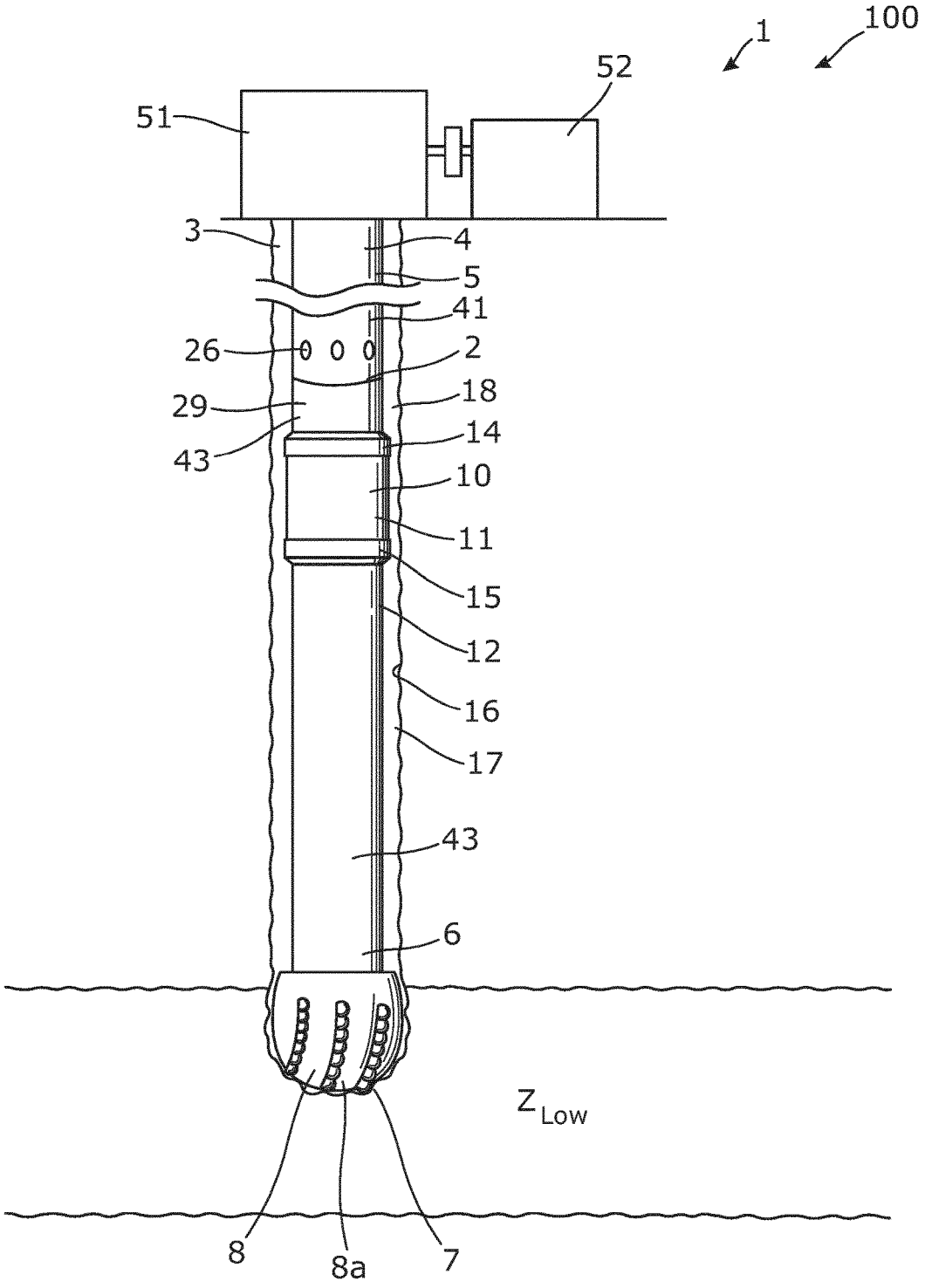
FIG. 11 shows another downhole string having a swivel.
Figure 12:
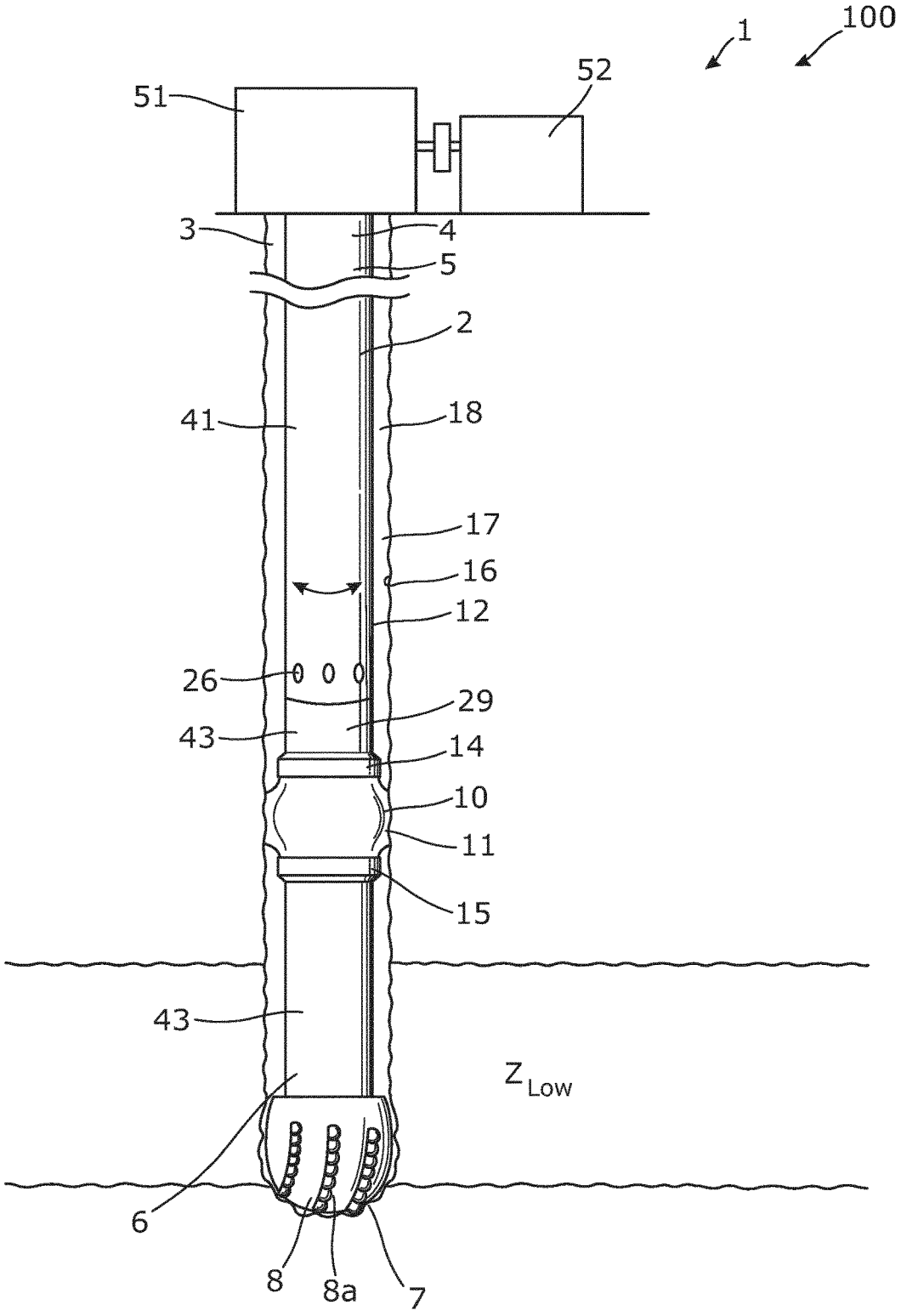
FIG. 12 shows the downhole string of FIG. 11 after expansion of the annular barrier.

In FIG. 11, the downhole string 1 further comprises a swivel 29 mounted as part of the drawdown casing, dividing the drawdown casing 2 into a first casing part 41 and a second casing part 43. The second casing part 43 is connected with the operational tool 8 and the annular barrier 10, and once the expandable metal sleeve 11 of the annular barrier is expanded, the second part of the drawdown casing 2 is fixedly fastened to the wall 16 of a borehole 17, as shown in FIG. 12. During a cement job, it is important to be able to rotate the casing in order to distribute the cement all around the annulus between the casing and the wall 16 of the borehole 17. By having a swivel 29, the first casing part 41 is able to rotate during the cement job without rotating the second casing part 43. The seal provided by the annular barrier 10 is thus maintained and not jeopardised by also rotating the second casing part 43. The openings 26 of the drawdown casing 2 are arranged above the annular barrier 10 and above the swivel 29.

Figure 13:
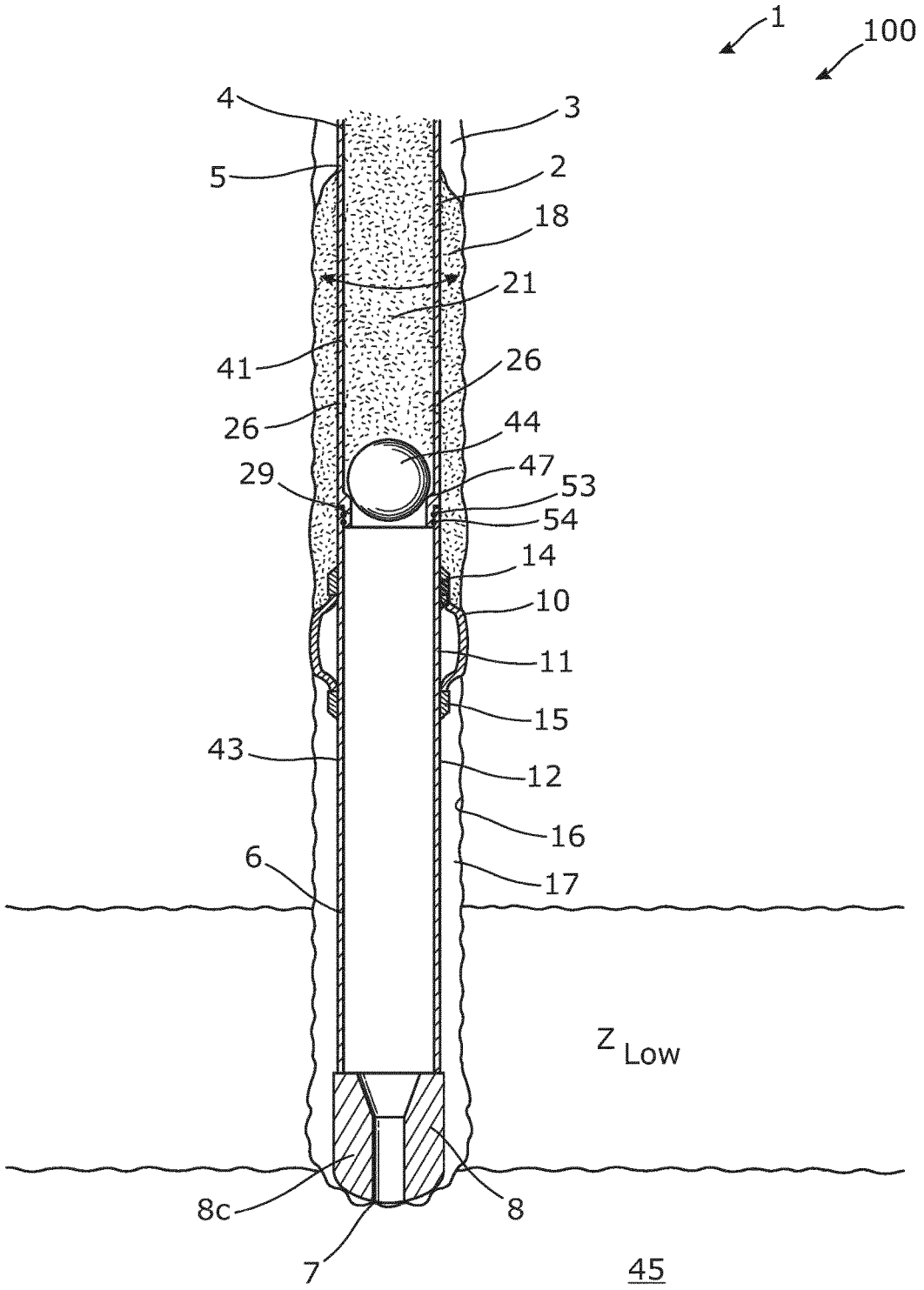
FIG. 13 shows a cross-sectional view of another downhole string having a swivel enabling rotation of part of the downhole string during cementing of the annulus.

FIG. 13 shows a cross-sectional view of another drawdown casing 2 in which the swivel 29 comprises a first swivel part 48 connected to the first casing part 41 and a second swivel part 49 connected to a second casing part 43. A ball bearing 53 is arranged between the first swivel part 48 and the second swivel part 49 to reduce the friction between first swivel part and the second swivel part when the first swivel part rotates in relation to the second swivel part. Furthermore, a sealing element 54 is arranged between the first swivel part 48 and the second swivel part 49, and this sealing element is thus part of a dynamic seal allowing the first casing part 41 to be rotated in relation to the second casing part 43 without causing a leak therebetween.

The invention further relates to a downhole system 100, shown in FIGS. 1-3, for drilling through a low pressure zone in a formation in a well, comprising the downhole string and an operating unit 51 for sliding and/or rotating the drawdown casing in relation to the expanded expandable metal sleeve of the annular barrier and thus the borehole. As can be seen, the downhole system 100 further comprises a pressurising unit 52 for pressurising a fluid in the drawdown casing 2 for expanding the expandable metal sleeve 11. In FIG. 3, the downhole system 100 further comprises a cementing tool 21. If no opening is present in the drawdown casing 2 above the annular barrier 10, openings may be made by means of a perforating gun.

In FIG. 13, the downhole system further comprising a ball 44 which has been dropped into the drawdown casing 2, abutting and seating in a seat 47 and closing part of the casing above the annular barrier 10. The seat 47 is arranged in the swivel 29 but may in another embodiment be arranged further down or up down the casing. The seat 47 is always arranged below the openings 26 to allow cement to enter into the annulus. The first casing part 41 can thus be rotated in relation to the second casing part 43, e.g. during a cement job.

Figure 14:
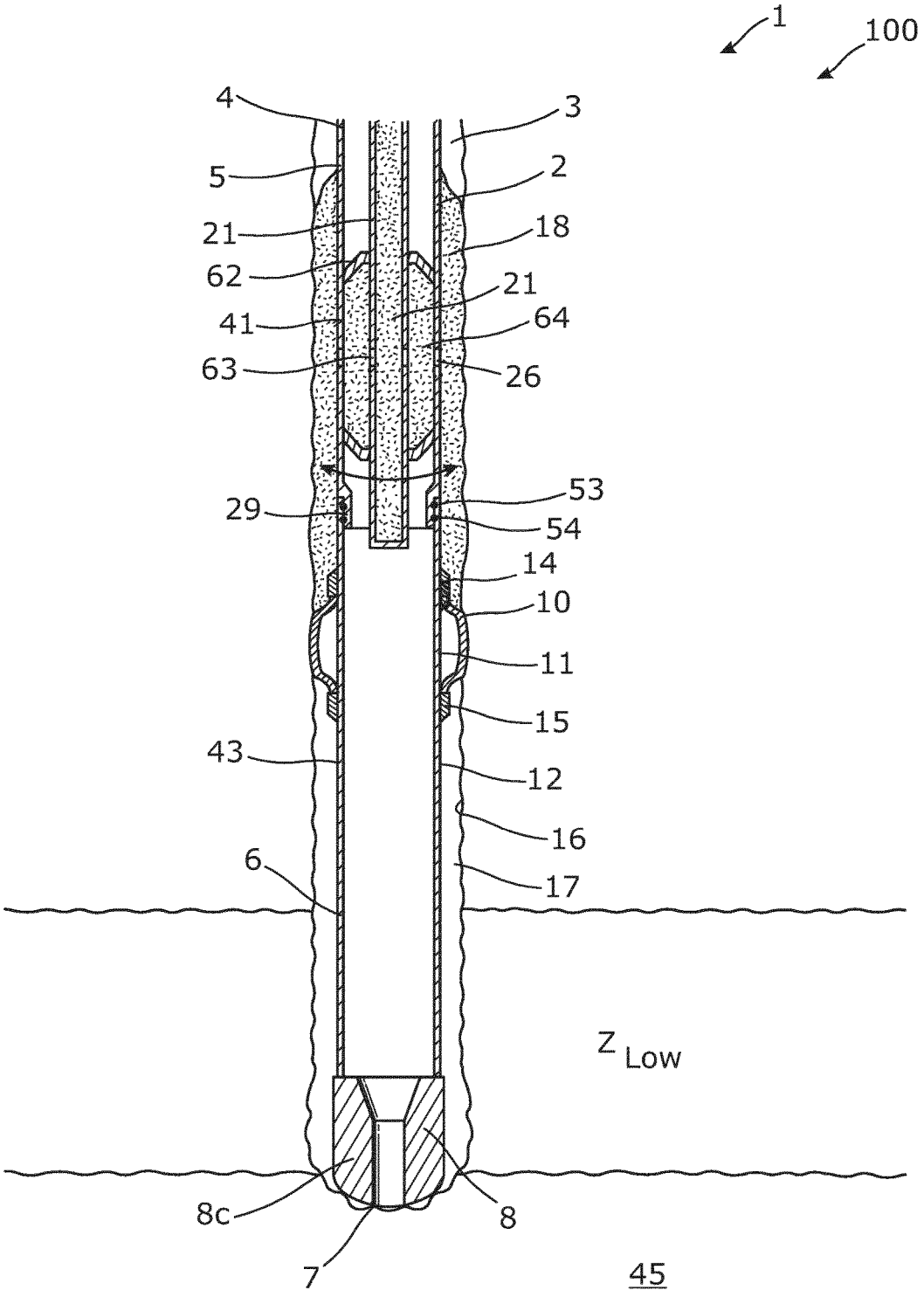
FIG. 14 shows a cross-sectional view of another downhole string into which a cement tool has been inserted.

In FIG. 14, the cementing tool 21 comprises cup seals 62 and an opening 63 arranged between the cup seals, providing a space 64 between the seals and the casing so that cement fed down the tool enters the space before entering the annulus between the wall 16 of the borehole 17 and the casing 2. The cementing tool 21 is arranged opposite the openings 26 in the drawdown casing 2 and above the swivel so that the first casing part 41 is able to rotate in relation to the second casing part 43, e.g. during a cement job.

The invention further relates to a downhole method for drilling past a low pressure zone in a formation in a well. First, a borehole is drilled and the presence of a low pressure zone is determined, and then the expandable metal sleeve of the annular barrier is expanded above the low pressure zone in relation to a top of the borehole. Subsequently, cement is provided above the annular barrier in an annulus between the casing and a wall of the borehole through an opening of the drawdown casing, e.g. a frac port or a perforated opening. When performing the cementing job, the casing is oscillated in relation to the annular barrier, and then the drilling process is continued, drilling past the low pressure zone, e.g. while rotating the drawdown casing. In order to continue the drilling operation, a drilling head and a drill pipe may be inserted into the drawdown casing.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a drawndown casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole string for drilling through a low pressure zone in a formation in a well, comprising:

a casing having a first end closest to a top of the well and a second end, and an operational tool connected to the second end of the casing, wherein the downhole string further comprises an annular barrier having an expandable metal sleeve surrounding the casing, each end of the expandable metal sleeve being connected with the casing, and the expandable metal sleeve being adapted to contact a wall of a borehole or another casing so that the casing can rotate and slide in relation to the annular barrier after expansion of the expandable sleeve, and wherein the downhole string further comprises a swivel mounted as part of the casing, dividing the casing into a first casing part and a second casing part for rotating the first casing part in relation to the second casing part.

2. The downhole string according to claim 1, wherein the swivel comprises a first swivel part connected to the first casing part and a second swivel part connected to a second casing part.

3. The downhole string according to claim 2, wherein a ball bearing is arranged between the first swivel part and the second swivel part.

4. The downhole string according to claim 1, wherein the second casing part is connected with the operational tool and the annular barrier.

5. The downhole string according to claim 1, wherein the casing comprises openings arranged above the annular barrier.

6. The downhole string according to claim 1, wherein an annular space is arranged between the expandable metal sleeve and the casing.

7. The downhole string according to claim 1, wherein the operational tool is a reamer, a drill head or a cement shoe.

8. A downhole system for drilling through a low pressure zone in a formation in a well, comprising:

a downhole string according to claim 1, and an operating unit for sliding and/or rotating the casing.

9. The downhole system according to claim 8, further comprising a pressurising unit for pressurising a fluid in the casing for expanding the expandable metal sleeve.

10. The downhole system according to claim 8, further comprising a downhole tool.

11. The downhole system according to claim 8, further comprising a ball configured to be dropped into the casing for seating in a seat and closing part of the casing.

12. A downhole method according to claim 1, wherein a sliding sleeve or a frac port is arranged in the casing closer to the first end in relation to the annular barrier.

13. A downhole string for drilling through a low pressure zone in a formation in a well, comprising:

a casing having a first end closest to a top of the well and a second end, and an operational tool connected to the second end of the casing, wherein the downhole string further comprises an annular barrier having an expandable metal sleeve surrounding the casing, each end of the expandable metal sleeve being connected with the casing, and the expandable metal sleeve being adapted to contact a wall of a borehole or another casing so that the casing can rotate and slide in relation to the annular barrier after expansion of the expandable sleeve, and wherein a sliding sleeve or a frac port is arranged in the casing closer to the first end in relation to the annular barrier.

14. A downhole method for drilling past a low pressure zone in a formation in a well, comprising:

drilling a borehole in the formation, determining a low pressure zone in the formation, expanding an annular barrier above the low pressure zone in relation to a top of the borehole, providing cement above the annular barrier in an annulus between a casing and a wall of the borehole, oscillating or rotating at least part of the casing in relation to the annular barrier while cementing, after expansion of an expandable sleeve of the annular barrier, drilling past the low pressure zone, and mounting a swivel as part of the casing, thereby dividing the casing into a first casing part and a second casing part for rotating the first casing part in relation to the second casing part.

15. The downhole method according to claim 14, wherein the drilling past the low pressure zone is performed after a drilling head and a drill pipe have been inserted into the casing.

16. The downhole method according to claim 14, wherein the providing cement is performed after a cementing tool has been arranged opposite an opening in the casing above the annular barrier.

* * * * *